US005518646A

United States Patent [19]

Van den Brom

[11] Patent Number: 5,518,646

[45] Date of Patent: May 21, 1996

[54] SOLID DETERGENT BRIQUETTES

[75] Inventor: Guido C. Van den Brom, Maarssen, Netherlands

[73] Assignee: Lever Industrial Company, Division of Indopco, Inc., Bridgewater, N.J.

[21] Appl. No.: 218,535

[22] Filed: Mar. 28, 1994

[30] Foreign Application Priority Data

Apr. 1, 1993 [EP] European Pat. Off. ..... 93200940

[51] Int. Cl.[6] ..... C11D 17/00; C11D 11/00; C11D 3/04

[52] U.S. Cl. ..... 252/174; 252/174.14; 252/174.23; 252/174.24; 252/135; 252/DIG. 2; 252/DIG. 16

[58] Field of Search ..... 252/174, 174.14, 252/174.23, 174.24, 135, DIG. 2, DIG. 16

[56] References Cited

U.S. PATENT DOCUMENTS

| | | | |
|---|---|---|---|
| 4,219,436 | 8/1980 | Gromer et al. | 252/135 |
| 4,576,722 | 3/1986 | Gaylor et al. | 210/699 |
| 5,294,361 | 3/1994 | Van den Brom | 252/90 |
| 5,316,688 | 5/1994 | Gladfelter et al. | 252/90 |

FOREIGN PATENT DOCUMENTS

| | | | |
|---|---|---|---|
| 0267042 | 5/1988 | European Pat. Off. | C11D 3/12 |
| 0375022 | 6/1990 | European Pat. Off. | C11D 17/00 |
| 0421664 | 4/1991 | European Pat. Off. | C11D 3/37 |
| 0507404 | 10/1992 | European Pat. Off. | C11D 17/04 |

*Primary Examiner*—Paul Lieberman
*Assistant Examiner*—Patricia Hailey
*Attorney, Agent, or Firm*—A. Kate Huffman

[57] ABSTRACT

A solid detergent composition in the form of briquettes of compressed granular detergent material is provided, said composition comprising from 0.1 to 10% by weight of a polycarboxylated polymer and from 0.1 to 20% by weight of a watersoluble inorganic carrier material for said polymer, the bulk density of said composition ranging from 1000 to 2100 kg/m$^3$. This composition was found to exhibit excellent compactibility and good anti-scaling properties.

5 Claims, No Drawings

SOLID DETERGENT BRIQUETTES

TECHNICAL FIELD

The present invention relates to solid detergent briquettes for obtaining an aqueous chemical solution having a substantially constant concentration. Such detergent briquettes are used in industrial cleaning processes such as mechanical warewashing or fabric washing, and generally comprise alkaline ingredients and detergency builders.

BACKGROUND OF THE INVENTION

For environmental reasons it has become desirable to reduce or eliminate the phosphate content of detergent formulations. Therefore, there is a trend towards detergent formulations containing no or reduced amounts of sodium tripolyphosphate builder material. However, a drawback of such formulations is that they may give rise to considerable scaling when applied in a washing machine. This drawback is most pronounced with detergent formulations having significant levels of alkaline ingredients such as silicates and carbonates. Such detergent formulations are usually applied in the area of industrial warewashing where they can be effectively used in the form of solid detergent briquettes. The reason for applying this type of detergent material is that it constitutes a concentrated as well as non-dusty and, therefore, relatively safe product form for the often aggressive chemicals included therein.

The accumulation of scale on table ware and on machine parts is an expensive problem causing delays and shutdowns and requiring many manhours for cleaning and removal. The term "scale" as used herein, includes deposits formed on the surface in contact with the wash liquor in the washing machine, and caused by the precipitation of metal ions from the wash liquor. There will be a considerable risk of scale formation if the wash liquor contains alkaline earth cations, such as calcium and magnesium, and anions such as carbonate, sulphate and silicate: combinations of these ions in concentrations exceeding their solubility limit form precipitates which deposit on the surface to be cleaned.

It is generally known that the accumulation of scale in aqueous systems, such as boiling water systems can be inhibited by addition to such systems of a mixture of a phosphonate and a water-soluble polymer. It is also known that treatment with such a mixture promotes the formation of a fluid sludge in the water which can be effectively conditioned and removed. U.S. Pat. No. 4,576,722 discloses a method of inhibiting the deposition of scale in a boiler water system, by adding to said boiler water a substantially water soluble polymer such as an acrylic acid polymer and a particular phosphonotricarboxylic acid.

Polymer containing formulations useful as a detergent constituent are also known in the art.

EP-A-421,664 is concerned with such detergent formulation which is in the form of granules and contains a polymer located on a water-soluble inorganic carrier material. This formulation contains at least 10% by weight of the polymer and at least 20% by weight of the carrier material, and the polymer is applied therein as a builder or anti-scaling component replacing as such the environmentally less desirable phosphate builders. This document also discloses a process for preparing the polymer containing formulation, which comprises mixing an aqueous solution of the polymer with the water-soluble inorganic carrier material, and subjecting the mixture to conditions of agitation and heat such that granules are formed.

EP-A-375,022 discloses a solid detergent composition in the form of a block of compressed granular material and a process for preparing this block-form detergent product. In this process a powder is compressed in a mould under a pressure of 3–30 kN/cm$^2$ to form said block-form product.

It was found that effective and highly concentrated solid detergent briquettes with a density of up to 2100 kg/m$^3$, can be produced by applying this compression process, for instance in a BEPEX briquetting machine. Such high density detergent briquettes are desirable for reducing cost of packaging, transportation and storage thereof and for minimizing the amount of packaging waste material.

In view of the foregoing, it is an object of the present invention to provide a detergent composition in the form of detergent briquettes of compressed granular material, which contains reduced levels of builder material, such as sodium tripolyphosphate, and which does not give rise to unacceptable scale formation when applied in a washing machine. It is a further object of the invention to provide a briquette-form detergent composition which is suitable for use in an industrial warewashing or fabric-washing machine.

We have now, surprisingly, found that these and other objects can be achieved by a solid detergent composition in the form of briquettes of compressed granular detergent material, comprising polycarboxylated polymer located on an inorganic watersoluble carrier material. Said briquettes were found to have optimal physical properties, such as density and compactibility, and good anti-scaling properties. In this context, a solid detergent briquette is defined as a discretely shaped solid detergent material which may be in the form of a block, tablet or cube, of which the shape and dimensions may vary with the application envisaged, and which may have a widely varying weight in the range of 0.001–5 kg, preferably 0.004–3 kg.

DEFINITION OF THE INVENTION

According to the present invention there is provided a solid detergent composition in the form of briquettes of compressed granular detergent material, comprising from 0.1 to 10% by weight of a polycarboxylated polymer and from 0.1 to 20% by weight of a watersoluble inorganic carrier material for said polymer, the bulk density of said composition ranging from 1000 to 2100 kg/m$^3$.

There is also provided a process for the manufacture of said solid detergent composition, whereby a powder having a corresponding composition is compressed in a mould under a pressure of 3–30 kN/cm$^2$ to form solid briquettes. Yet another aspect of the invention is the use of a solid detergent composition according to the invention in an industrial warewashing or fabric washing process.

DETAILED DESCRIPTION OF THE INVENTION

The solid detergent briquettes of the invention generally contain detergent components usually found in detergent material suitable for use in a washing machine, in particular an industrial washing machine. These detergent component comprise a builder, an alkaline agent, a bleaching agent and one or more types of, preferably low foaming, nonionic surfactant material.

The density of the briquettes of the invention is generally in the range of from 1000 to 2100 kg/m$^3$, preferably 1600 to 2000 kg/m$^3$.

Builder Material

Generally, the detergent briquettes of the invention may contain up to 60% by weight of builder material. However, the solid detergent briquettes containing polycarboxylated polymer on an inorganic carrier are most favourably used under conditions where reduction or elimination of possible scale formation is of major interest. Therefore, the invention is especially concerned with solid detergent briquettes containing reduced levels of builder material of at most 30% by weight, preferably in the range of from 0 to 25% by weight.

This builder material is generally defined to be any material capable of reducing the level of free calcium and magnesium ions in the wash liquor and, preferably, providing the composition with other beneficial properties such as the generation of an alkaline pH and the suspension of soil removed from the substrate to be cleaned.

Preferred builders are phosphate builders such as pyrophosphate, orthophosphate or tripolyphosphate, and ion exchange builders such as crystalline (zeolite) or amorphous aluminosilicate. Optionally, the following organic builders may be effectively used in the detergent composition of the present invention: citrates, nitrilotriacetates, phytates, polyphosphonates, oxydisuccinates, oxydiacetates, carboxymethyloxy succinates, tetracarboxylates, and oxydised heteropolymeric polysaccharides. Other preferred builder systems are precipitant builders such as those containing calcite and carbonate as described in EP-A-267,042.

Alkaline Material

Depending on the specific application the briquettes contain, in addition to the above builder component, 10–80% by weight, preferably 10–70% by weight of an alkaline agent, such as sodium- or potassium-hydroxides, -silicates,in particular -metasilicates, or -carbonates. Generally, compositions for use in a mechanical warewashing machine are most alkaline and contain the highest levels of these alkaline agents, which levels are suitably in the range of 20–70% by weight.

The Anti-scaling Agent

The briquettes of the present invention generally contain 0.1–10% by weight of a polycarboxylated polymer and 0.1–20% by weight of an inorganic watersoluble carrier material therefore as an anti-scaling agent.

For the purpose of the present invention, an anti-scaling agent is defined as a material which reacts with the scale forming components in the wash liquor and alters the crystalline character and amount of precipitate formed in the wash liquor, thus inhibiting or reducing scale formation.

The anti-scaling agent is, preferably, substantially homogeneously mixed throughout the briquette. The level of polycarboxylated polymer is, preferably, in the range of from 1 to 5% by weight, whereas the preferred concentration range of the carrier material is from 2 to 10% by weight.

Suitable polycarboxylated polymers according to the invention are selected from the group consisting of homopolymers and copolymers of one or more of acrylic acid, methacrylic acid, maleic acid, acrylamide, itaconic acid, ($C_1$–$C_4$)-alkyl (meth)-acrylates or amides, alpha-chloroacrylic acid, alkyl-vinylether or vinylesthers. Most preferred polymers are selected from the group of homopolymers and copolymers of acrylic acid and maleic acid.

Suitable watersoluble inorganic carrier material according to the invention is selected from the group consisting of sulphates, carbonates, silicates, aluminosilicates, percarbonates, perborates, clays, and mixtures thereof. Most preferred carrier material is selected from silicates, carbonates and mixtures thereof.

Significantly improved results with regard to the elimination or reduction of scale formation were found when applying solid detergent briquettes containing 2-phosphonobutane- 1,2,4 tricarboxylicacid or the metals thereof, in addition to the above described anti-scaling agent. Suitable levels of this additional component which as such is also an anti-scaling agent, are within the range of from 0.5 to 10% by weight.

Other Ingredients

The detergent briquettes of the invention may, further, contain 1–5% by weight of an active chlorine bleach such as sodium dichloro-isocyanurate, or, alternatively, 5–20% by weight of an oxygen bleach, for example in the form of an inorganic persalt, preferably with a precursor. From an environmental point of view, the most preferred bleach compound is percarbonate.

It is a specific advantage of the compressed detergent briquettes according to the invention that high levels of such bleaches may be incorporated and that the bleach material present therein remains stable for several months. In comparable briquettes obtained by hydration, the active chlorine or oxygen content is known to decrease rapidly in time.

For warewashing purposes, it is common to use an anti-foam agent such as a low- or non-foaming nonionic surfactant in the wash liquor and such agents may indeed be incorporated in the solid detergent briquettes according to the invention. Other suitable anti-foaming agents are calcium or magnesium salts of fatty acids, long chain ketones having more than 25 carbon atoms, and a combination of hydrocarbon wax and alkyl phosphate. Alternatively,silicone oil based compositions containing high and low viscosity silicone oil, particularly high viscosity silicone oil, may be effectively used as anti-foaming agents. A level of the anti-foaming agent ranging from 0 to 5% by weight proved to be effective.

The briquettes according to the invention may further comprise suitable minor ingredients, such as bleach stabilizers, enzymes, etc. Additional components may be compaction aids, for instance magnesium stearate, hydrophobic silica or talc powder, and solubility aids, such as polyethylene glycol or carbowax.

Process

During manufacture of the briquettes of the invention, it is preferred that all solid starting materials should be dry and (in the case of hydratable salts) in a low hydration state. For instance, anhydrous phosphate builder is preferably used if this type of builder is applied as a constituent of the briquettes.

According to the process of the invention, a suitable granular detergent powder corresponding to the desired chemical composition and including the anti-scaling agent of the invention is formed and subsequently compressed in a mould under a pressure of 3–30 $kN/cm_2$. Preferably, the anti-scaling agent is homogeneously distributed through the powder before compression of said powder is carried out.

This process can be carried out in a suitable press, preferably a hydraulic press, for instance a LAEIS Hydraulische Doppeldrückpresse, TYP HPF 630 as manufactured by LAEIS, West-Germany. It proved to be especially advantageous to form the briquettes by two or more consecutive pressings, optionally of increasing pressure. In that case, in the first step, a pre-compaction is achieved at a relatively low pressure of 3–10 kN/cm$^2$, which is then followed by one or more steps at a relatively high pressure of 10–30 kg/cm$^2$. Following this procedure, a higher degree of compaction can be achieved than by using one single pressing. Alternatively, the detergent briquettes of the present invention can be effectively prepared by compression of a granular detergent powder having the desired chemical composition in a BEPEX briquetting machine using a pressure ranging from 50 to 200 kN.

Since the pressing can be carried out at ambient temperature, considerable levels of heat-sensitive components, such as bleach compounds or enzymes, may be incorporated in the briquettes. This is regarded as an additional advantage of this process. After manufacture, the briquettes should be packaged as soon as possible, owing to their hygroscopic nature.

Use

Another aspect of the invention is the use of the solid briquettes according to the invention in an industrial ware-washing or fabric washing process.

In use, the compressed detergent briquettes may be placed inside a suitable dispenser, in which they are sprayed upon with water in order to obtain an aqueous solution of the solid detergent material. Depending on the nature of the solid detergent briquettes, the water may also form a slurry or suspension of the chemical material contained therein. Alternatively, the compressed detergent briquettes of the invention may be applied as a constituent of the detergent composition present in a sachet according to the European patent application no. 507,404.

The invention is further illustrated by the following non-limiting Examples, in which parts and percentages are by weight unless otherwise stated.

In the Examples the following abbreviations are used:

| | |
|---|---|
| STP | sodium trpolyphosphate |
| SMS 0aq | anhydrous sodium metasilicate |
| SMS 5aq | sodium metasilicate containing 5 moles of water |
| Bayhibit S | 2-phosphono-butane-1,2,4 tricarboxylic acid, ex Bayer |
| WL2-Si | 40% polyacrylate (mol wt 4500) on 30% sodium silicate ($Na_2O$:$SiO_2$ ratio = 2) and 30% sodium carbonate, Norasol ex Norsohaas |
| LMW 45 ND | polyacrylate (mol wt 4500), Norasol ex Norsohaas |
| Plurafac LF 403 | Nonionic surfactant, ex BASF |
| CDB Clearon | Sodium dichloroisocyanurate dihydrate |

EXAMPLES 1–6

Comparative Example A

A series of granular, low phosphate, detergent powders were formulated having the composition shown in Table 1:

TABLE 1

| | % wt |
|---|---|
| STP | 21.6 |
| SMS 0aq | 24.3 |
| Anti-scaling agent | 0–5.0 |
| SMS 5aq | balance |

The anti-scaling agent was selected from (Norasol) WL2-Si, and mixtures thereof with Bayhibit S, as shown below.

Tablets of 20 grams (r=1.81 cm) and tablets of 2 grams (r=0.65 cm) were prepared from these powders by using a laboratory press (Speca automatic hydraulic press, P/N 15710) and applying a pressure of 0.8 t/cm$^2$ and 1.5 t/cm$^2$ respectively.

Thereafter, anti-scaling effects were measured using the following test procedure.

A hard water stock solution was prepared by diluting 109.0 gr $CaCl_2$, $H_2O$ and 30.3 gr $MgCl_2$*$6H_2O$ with 500 ml deionised water. Subsequently, a hard water solution was prepared by diluting 7.6 gr of this stock solution and 1.52 gr $NaHCO_3$ to 4 liter with deionised water. The pH is adjusted to 6.5– 7 with 1M HCl. A detergent product stock solution was prepared having a dilution of 50 gr product/950 ml water.

Approximately 250 ml of the hard water solution was preheated to 80°–85° C. in a microwave during 3–4 minutes.

1 grams, 2 grams and 3 grams of the product stock solution were weighed in a 250 ml clean beakerglass and 100 grams of the preheated hard water solution were added. As a result, 0.5 g/l, 1.0 g/l and 1.5 g/l product solutions were formed. These solutions were stirred for 2 minutes at 80° C. to ensure dissolution, and were subsequently allowed to stand for 8 minutes at 80° C. Thereafter, the product solutions were discarded and the residue was washed 3 times. Finally, the beakerglass was rinsed with deionised water and the residue (i.e. scale formation) allowed to dry.

In order to be able to measure the amount of scale, the beakerglass was rinsed with 2*4 ml of molar hydrochloric acid to dissolve the scale. The hydrochloric acid including the dissolved scale was transferred from the beakerglass to a 250 ml conical flask, and 3 ml ammonia solution (25%) and 1 Indicator buffertablet ( Art. 8430, ex Merck) were added.

The resulting solution was titrated to a green end point with a diluted Titriplex B solution ( Titrisol 9895, ex Merck), containing 100 ml of said Titriplex B solution diluted to 1000 ml with deionised water. Each ml of diluted Titriplex solution required is equivalent to 0.18 mg $CaCO_3$ scale formation.

The results found are shown in Table 2.

TABLE 2

| Example | Anti-scaling agent | | Scale in mg $CaCO_3$ at a product concentr. of | | |
|---|---|---|---|---|---|
| Nr. | type | level (% wt) | 0.5 g/l | 1.0 g/l | 1.5 g/l |
| A | — | 0.0 | 4.84 | 0.94 | 0.62 |
| 1 | WL2-Si | 1.0 | 4.68 | 1.01. | 0.41 |
| 2 | WL2-Si | 2.5 | 3.92 | 0.98 | 0.41 |
| 3 | WL2-Si | 5.0 | 2.75 | 0.53 | 0.31 |
| 4 | Bayhibit S/WL2-Si | 1.5/1.0 | 2.56 | 0.42 | 0.23 |
| 5 | Bayhibit S/WL2-Si | 1.5/2.0 | 2.77 | 0.27 | 0.32 |
| 6 | Bayhibit S/WL2-Si | 1.5/3.0 | 2.67 | 0.39 | 0.28 |

It is noted that the percentage shown for the level of WL2-Si relates to the amount of active polyacrylate material present.

It can be seen that the anti-scaling effect is, generally, most pronounced when the highest detergent concentration is applied. It can also be noticed that the anti-scaling effect caused by the mixture of anti-scaling agents is considerably larger than the anti-scaling effect caused by the polymer-on-carrier material (Norasol) WL2-Si.

EXAMPLE 7

Comparative Example B

These Examples were carried out to find the influence of the type of polymer on the compaction properties of the powders from which detergent tablets are produced. For this purpose, detergent powder formulations having the following compositions were prepared.

TABLE 3

| Example nr. | 7 % wt | B % wt |
|---|---|---|
| STP | 21.6 | 21.6 |
| SMS 0aq | 24.3 | 24.3 |
| SMS 5aq | 32.1 | 39.6 |
| Bayhibit S | 1.5 | 1.5 |
| (Norasol) WL2-Si | 12.5 | |
| (Norasol) LMW 45 ND | | 5.0 |
| Plurafac LF403 | 1.6 | 1.6 |
| Mg stearate | 2.0 | 2.0 |
| Ca Behenate | 1.0 | 1.0 |
| CDB Clearon | 3.4 | 3.4 |

Thereafter, tablets were prepared from these powder formulations by applying the compaction process described in the preceeding Examples. As a result, varying tablet heights and densities were found, as shown in Table 4.

TABLE 4

| Example nr. | 7 | B |
|---|---|---|
| Tablet I (20 g, r = 1.81 cm) | | |
| Tablet height (mm) | 11.1 | 11.4 |
| Tablet density (kg/dm$^3$) | 1.76 | 1.71 |
| Tablet II (2 g, r = 0.65 cm) | | |
| Tablet height (mm) | 8.38 | 8.55 |
| Tablet density (kg/dm$^3$) | 1.80 | 1.76 |

The polymer concentration in the polymer-on-carrier material (Norasol) WL2-Si is 40% wt. Therfore, the "active" polymer level present in the tablets of Example 7, is equal to the polymer level in the compositions according to the comparative Examples B.

The effect on the obtainable density caused by the polymer-on-carrier material WL2-Si according to the present invention can be clearly noticed, when comparing Examples 7 and B both of which being concerned with tablets containing 5% wt active polymer material. A significantly higher tablet density and a correspondingly lower tablet height were obtained when applying (Norasol) WL2-Si as a constituent of the tested tablets.

I claim:

1. A solid detergent composition comprising:

a) from 1 to 5% by weight of a polycarboxylated polymer selected from the group consisting of homopolymers and copolymers of an acrylic acid and a maleic acid;

b) from 2 to 10% by weight of a water-soluble inorganic carrier material for said polymer, the carrier material selected from the group consisting of silicates, carbonates and mixtures thereof; and c) from 0.5 to 10% by weight of a compound selected from the group of 2-phosphonobutane- 1,2,4-tricarboxylic acid and the metal salts thereof, the bulk density of said composition ranging from 1000 to 2100 kg/m$^3$ and the composition in the form of briquettes of compressed granular detergent material.

2. Solid detergent composition according to claim 1, comprising from 10 to 70% by weight of an alkaline agent and from 0 to 60% by weight of a detergency builder.

3. Process for the manufacture of a solid detergent composition according to claim 1, whereby a powder having a corresponding composition is compressed in a mould under a pressure of 3–30 kN/cm$^2$ to form solid briquettes.

4. Process according to claim 3, wherein the briquettes are formed by two or more consecutive pressings.

5. A method of using a solid detergent composition comprising the steps of a) choosing a solid detergent composition comprising:

(i) from 1 to 5% by weight of a polycarboxylated polymer selected from the group consisting of homopolymers and copolymers of an acrylic acid and a maleic acid;

(ii) from 2 to 10% by weight of a water-soluble inorganic carrier material for said polymer, the carrier material selected from the group consisting of silicates, carbonates and mixtures thereof; and (iii) from 0.5 to 10% by weight of a compound selected from the group of 2-phosphonobutane- 1,2,4-tricarboxylic acid and the metal salts thereof, the bulk density of said composition ranging from 1000 to 2100 kg/m$^3$ and the composition in the form of briquettes of compressed granular detergent material; and b) using the solid detergent composition in an industrial warewashing or fabric washing process.

* * * * *